US006532025B1

(12) United States Patent
Hiramatsu

(10) Patent No.: US 6,532,025 B1
(45) **Date of Patent: *Mar. 11, 2003**

(54) INK JET RECORDING APPARATUS PROVIDED WITH AN IMPROVED CLEANING MECHANISM

(75) Inventor: Soichi Hiramatsu, Hachioji (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,285

(22) Filed: Nov. 13, 1998

(30) Foreign Application Priority Data

Nov. 14, 1997 (JP) ..... 9-331146

(51) Int. Cl.[7] ..... B41J 2/165
(52) U.S. Cl. ..... 347/29
(58) Field of Search ..... 347/29, 30, 31, 347/32, 33; 400/701, 702; 15/256.5

(56) References Cited

U.S. PATENT DOCUMENTS

| | | | | | |
|---|---|---|---|---|---|
| 4,819,012 A | * | 4/1989 | Kiyohara et al. | ..... | 347/31 |
| 5,051,758 A | * | 9/1991 | Markham | ..... | 347/28 |
| 5,097,276 A | * | 3/1992 | Midorikawa | ..... | 347/33 |
| 5,155,497 A | * | 10/1992 | Martin et al. | ..... | 347/33 |
| 5,581,282 A | * | 12/1996 | Okamura | ..... | 347/33 |
| 5,587,729 A | * | 12/1996 | Lee et al. | ..... | 347/32 |
| 5,663,751 A | | 9/1997 | Holbrook | ..... | 347/22 |
| 5,815,176 A | * | 9/1998 | Rotering | ..... | 347/33 |
| 5,907,335 A | * | 5/1999 | Johnson et al. | ..... | 347/28 |

FOREIGN PATENT DOCUMENTS

| | | | | |
|---|---|---|---|---|
| EP | 0 395 004 | | 10/1990 | ..... B41J/2/165 |
| EP | 0 585 923 | | 3/1994 | ..... B41J/2/165 |
| JP | 57-63267 | | 4/1982 | ..... B41J/3/04 |
| JP | 57-193369 | | 11/1982 | ..... B41J/3/04 |
| JP | 58-108155 | | 6/1983 | ..... B41J/3/04 |
| JP | 62-288047 | | 12/1987 | ..... B41J/3/04 |
| JP | 6-198897 | * | 7/1994 | ..... 347/33 |
| JP | 6-255117 | * | 9/1994 | ..... B41J/2/165 |
| JP | 406262768 | * | 9/1994 | ..... 347/32 |
| JP | 6-340082 | | 12/1994 | ..... B41J/2/165 |
| JP | 7-9674 | | 1/1995 | ..... B41J/2/01 |
| JP | 7-52396 | | 2/1995 | ..... B41J/2/165 |
| JP | 7-96604 | | 4/1995 | ..... B41J/2/01 |
| JP | 8-118674 | | 5/1996 | ..... B41J/2/175 |

* cited by examiner

*Primary Examiner*—John S. Hilten
*Assistant Examiner*—K. Feggins
(74) *Attorney, Agent, or Firm*—Fitzpatrick, Cella, Harper & Scinto

(57) ABSTRACT

An ink jet recording apparatus for discharging ink from a recording head to a recording material to thereby effect recording has a contacting member for cleaning the discharging surface of the recording head. The contacting member is rotatable until immediately before it contacts with the discharging surface, and the rotation of the contacting member is fixed when the contacting member contacts with the discharging surface.

23 Claims, 11 Drawing Sheets

INK JET RECORDING APPARATUS PROVIDED WITH AN IMPROVED CLEANING MECHANISM

BACKGROUND OF THE INVENTION

Field of the Invention and Related Art

This invention relates to an ink jet recording apparatus provided with a cleaning mechanism for cleaning the ink discharging surface of an ink jet recording head for discharging ink to a recording material to thereby effect recording, and particularly to an ink jet recording apparatus provided with a cleaning mechanism of a roller type which makes improved cleaning possible.

A recording apparatus having the function of a printer, a copying apparatus, a facsimile apparatus or the like, or a recording apparatus used as the output instrument of a compound type electronic apparatus including a computer, a word processor or the like or of a work station is designed to record images (including characters, symbols, etc.) on a recording material such as recording paper or a plastic sheet on the basis of recording information. Such recording apparatus can be grouped into an ink jet type, a wire dot type, a thermal type, a laser beam type, etc. depending on the recording system thereof.

Among these, a recording apparatus of the ink jet type (ink jet recording apparatus) discharges ink from recording means (recording head) to a recording material to thereby effect recording, and has the advantages that it is easy to make the recording means compact, highly accurate images can be recorded at a high speed, recording can be done without requiring any special treatment of plain paper, the running cost is low and due to its being a non-impact system, noise is little and moreover, it is easy to use many kinds of inks (e.g., color inks) to second color images.

Also, there are various requirements for the quality of the recording material and in recent years, development for these requirements has been advanced, and recording apparatuses using, besides paper (including paper sheets and worked paper) which is an ordinary recording material and resin sheets (OHP or the like), cloth, leather, unwoven fabrics and metals or the like as recording materials have come to be used.

In the above-described ink jet recording apparatus, ink is discharged from minute discharge ports formed in the discharging surface of a recording head to recording paper, and the recording paper and the recording head are moved relative to each other to thereby effect recording. Therefore, there may result a situation in which ink droplets, dust or paper powder adheres to the discharging surface and the adhering materials are solidified, and this has affected the discharged state of the ink and in some cases, has resulted in non-discharge.

With a view to improve such a situation, generally a cleaning mechanism is provided in the apparatus and a cleaning operation is executed for the discharging surface of the recording head periodically or at predetermined timing so as to remove the foreign substances such as ink droplets, dust, paper powder and solidified materials, and this is an important technical element in ink jet recording.

There have been proposed various examples of the construction for cleaning adopted in the ink jet recording apparatus. They include, for example, a construction in which a plate-like elastic member is brought into frictional contact with the discharging surface (Japanese Laid-Open Patent Application No. 6-340082 and Japanese Laid-Open Patent Application No. 7-9674), a construction in which an absorbent member is brought into frictional contact with the discharging surface (Japanese Laid-Open Patent Application No. 7-52396), and a construction in which a rotatable member is rotated and the discharging surface is brought into frictional contact therewith (Japanese Laid-Open Patent Application No. 57-63267, Japanese Laid-Open Patent Application No. 57-193369, Japanese Laid-Open Patent Application No. 62-288047, Japanese Laid-Open Patent Application No. 6-255117 and Japanese Laid-Open Patent Application No. 7-96604).

FIGS. 11 through 14A, 14B and 14C of the accompanying drawings schematically shows some examples of the cleaning mechanism.

FIG. 11 shows an example of the construction which uses a plate-like elastic member (a wiping blade) to effect cleaning and in which on one end portion off the recording area of a recording apparatus 101, a wiping blade 104 is disposed as one of recovery mechanisms 102 adjacent to a capping mechanism 103. The wiping blade 104 utilizes the movement of a recording head 106 carried on a carriage 105 to the recovery mechanisms 102 to frictionally contact with the discharging surface and effect cleaning.

FIG. 12 shows an example of the cleaning mechanism in which an absorbent member 110 is disposed, and with a view to well remove a solidified material which cannot be removed by a wiping blade 104, the absorbent member 110 is disposed at a location adjacent to the wiping blade 104 and utilizes the movement of a recording head to the recovery mechanisms 102 to frictionally contact with the discharging surface and effect cleaning.

FIGS. 13A and 13B show examples of the cleaning construction utilizing a rotatable member 111, and without utilizing the movement of a carriage, the rotatable member 111 itself rotates while being in contact with the discharging surface 106*a* of a recording head 106 to thereby execute cleaning. The examples shown in FIGS. 13A and 13B are a construction in which the rotatable member is disposed in a cap mechanism, and after the recording head has been capped by a capping member, as shown in FIG. 13A, the rotatable member 111 is moved so as to contact with the discharging surface 106*a,* and in response to the rotatable force of another rotatable member 112 connected to a drive source in the direction of arrow a, the rotatable member 111 is rotated in the direction of arrow b and cleans the discharging surface 106*a*. At a point of time whereat the cleaning has been completed, as shown in FIG. 13B, the rotatable member 111 is moved to its initial position separate in the direction of arrow e from the discharging surface 106*a*.

FIGS. 14A to 14C show another examples of the cleaning construction utilizing a rotatable member. In these examples, the rotatable member 111 is moved on the discharging surface 106*a* while being rotated to thereby make it possible to clean the entire discharging surface. In the construction shown in FIGS. 14A to 14C, the rotatable member 111 executes its rotating operation by having a rotating operation from another rotatable member 112 transmitted thereto, and by the movement of said another rotatable member 112 with an arm 113 extending from the center of rotation thereof to the rotatable member as the radius, the rotatable member is moved from one side to the other side of the discharging surface 106*a* to thereby clean the entire discharging surface. At this time, the direction of rotation of the rotatable member is the same direction (arrow f in FIG. 14A and arrow p in FIG. 14B) as the direction of movement (arrow m in FIG. 14B) of the rotatable member, whereby firm cleaning is made possible.

For example, in the construction of a cleaning member using an absorbent member, however, an adhering substance comes to remain with an increase in the frequency of frictional contact and in some cases, sufficient cleaning performance cannot be expected. Also, the surface of the absorbent member becomes roughened by an increase in the frequency of the frictional contact with the discharging surface, and the cleaning performance may be gradually deteriorated.

Also, in the construction wherein the movement of the rotatable member and the rotation of the rotatable member are in the same direction and cleaning is effected, the load to the discharging surface is great, thus helping the deterioration of the characteristic of the rotatable member or scraping off the water repellent finish provided on the discharging surface, or these become complex and injure the discharging surface, and this has led to the possibility that ink discharging performance cannot be recovered in spite of the recovering process being carried out.

SUMMARY OF THE INVENTION

The present invention intends to improve the situation as noted above and an object thereof is to provide an ink jet recording apparatus which is provided with cleaning means capable of maintaining stable cleaning performance for a long period when cleaning the discharging surface of a recording head and which can achieve stable ink discharge for a long period.

It is also an object of the present invention to provide a construction which reduces a load to a cleaning member in cleaning and yet can sufficiently obtain the cleaning effect, and to provide an ink jet recording apparatus which secures sufficient cleaning performance and also maintains ink discharging performance.

It is also an object of the present invention to provide an ink jet recording apparatus for discharging ink from recording means to a recording material to thereby effect recording, characterized by a contacting member for cleaning the discharging surface of the recording means, the contacting member being rotatable until immediately before it contacts with the discharging surface, and the rotation being fixed when the contacting member contacts with the discharging surface.

It is also an object of the present invention to provide an ink jet recording apparatus for discharging ink from recording means to a recording material to thereby effect recording, characterized by a contacting member for cleaning the discharging surface of the recording means, the contacting member being moved relative to the discharging surface while being in contact with the discharging surface during paper feeding reverse rotation, the contacting member being rotated and in contact with a re-transfer member during further paper feeding reverse rotation, the contacting member being returned to its initial position during paper feeding forward rotation.

It is a further object of the present invention to provide an ink jet recording apparatus for discharging ink from recording means to a recording material to thereby effect recording, characterized by a contacting member for cleaning the discharging surface of the recording means, and a cap member for protecting the discharging surface, the contacting member and the cap member being disposed on opposite sides with a recording area therebetween.

DESCRIPTION OF THE PREFERRED EMBODIMENTS

Figure 1:
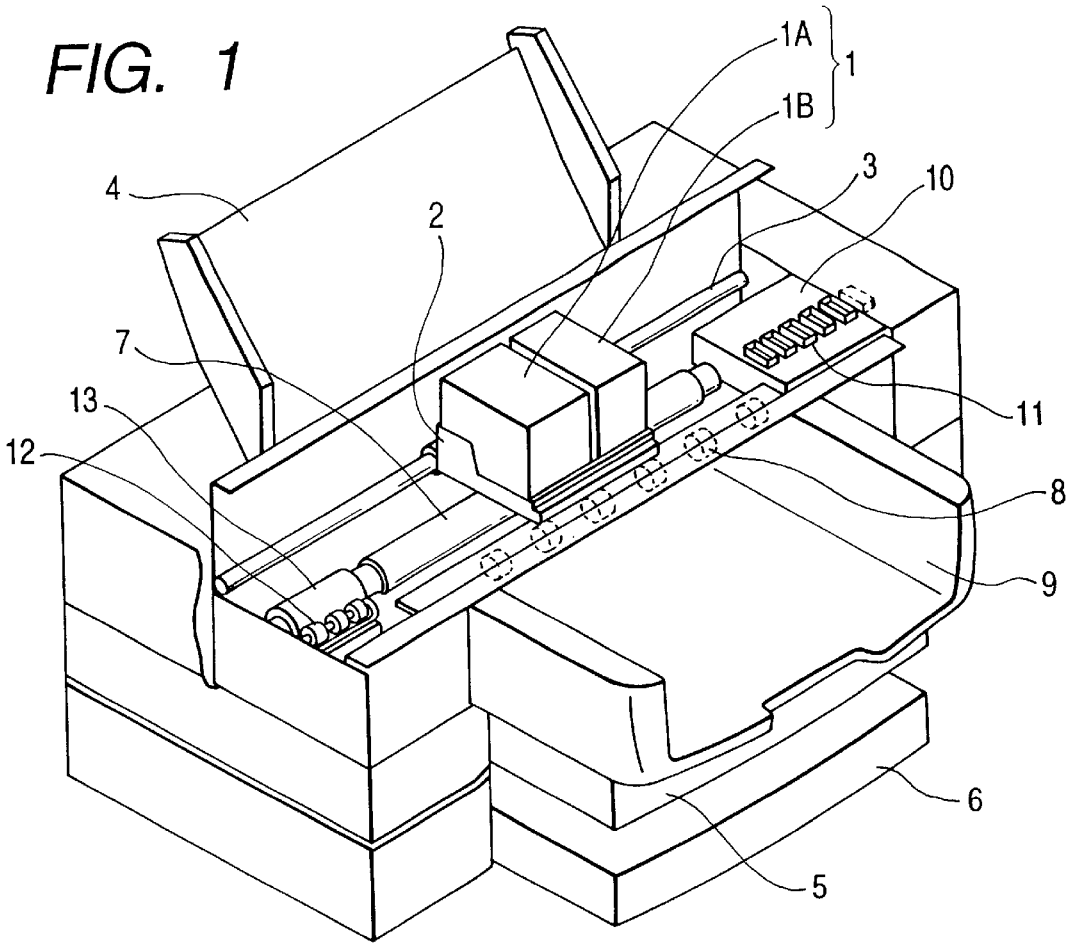
FIG. 1 is a typical perspective view showing an embodiment of an ink jet recording apparatus to which the present invention is applied.

Some embodiments of the present invention will hereinafter be described with reference to the drawings. Throughout the drawings, like or corresponding portions are designated by like reference numerals. FIG. 1 is a typical perspective view showing an embodiment of an ink jet recording apparatus to which the present invention is applied. In FIG. 1, a carriage 2 carrying two kinds of recording heads (recording means) 1A and 1B is supported for reciprocal movement along a guide shaft 3. A recording material such as recording paper (not shown) fed from an auto sheet feeder (ASF) or a cassette 5 or a cassette 6 is supplied to a recording portion by a line feed roller (LF roller) 7, and the recording material on which recording has been effected by the recording heads 1 is discharged onto a stacker 9 by a paper discharging roller 8.

A recovery system (recovery device) 10 having caps 11, etc. is disposed on the right side in FIG. 1. The recovery system 10 is provided with six caps 11, which correspond to the three series of discharging surfaces of the recording head 1A and the three series of discharging surfaces of the recording head 1B, six series of discharging surfaces in total. On the other hand, on the left side in FIG. 1, there are disposed three contacting members (wiping members, i.e., wipers) 12 capable of frictionally contacting with the discharging surfaces of the recording heads 1, and a re-transfer member 13 capable of contacting with these contacting members 12. In the present embodiment, the re-transfer member 13 is mounted around the left shaft portion of the line feed roller 7.

The recording heads 1 (1A and 1B) are ink jet recording heads for selectively discharging ink from a plurality of discharge ports to thereby effect recording by applying energy thereto in conformity with a recording signal. Also, these recording heads are ink jet recording means utilizing heat energy to discharge ink, and provided with electrothermal converting means for generating heat energy. Further, the recording heads 1 utilize a pressure change caused by the growth and contraction of an air bubble by film boiling caused by heat energy applied by the electrothermal converting means to discharge the ink from the discharge ports and effect recording. The electrothermal converting means are provided correspondingly to respective ones of the discharge ports, and by applying a pulse voltage to a corresponding electrothermal converting means in conformity with a recording signal, the ink is discharged from a corresponding discharge port.

Figure 2:
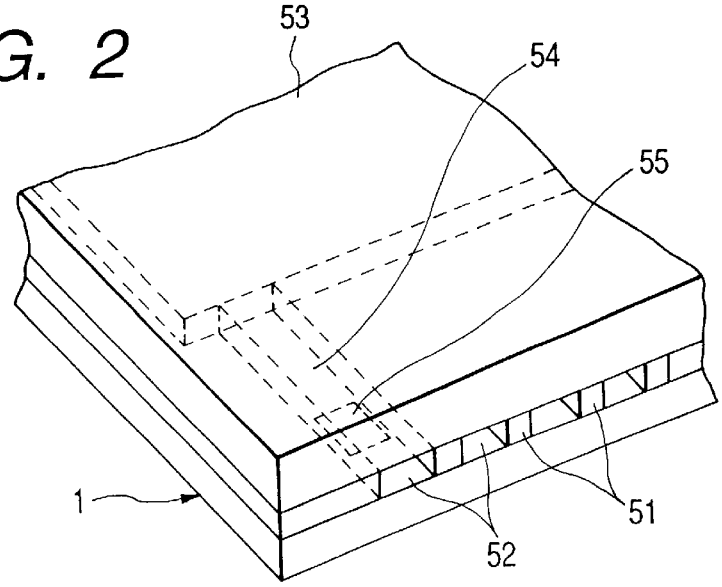
FIG. 2 is a fragmentary perspective view typically showing the structure of the ink discharging portion of recording means.

FIG. 2 is a fragmentary perspective view typically showing the structure of the ink discharging portion (a row of discharge ports) of the recording means (recording heads) 1. In FIG. 2, a discharging surface 51 facing the recording material (such as recording paper) with a predetermined gap (e.g. about 0.3 to 2.0 mm) therebetween is formed with a plurality of discharge ports 52 at a predetermined pitch, and electrothermal converting means (such as heat generating resistance members) 55 for generating ink discharging energy are disposed along the wall surfaces of respective liquid paths 54 communicating the discharge ports 52 with a common liquid chamber 53. The recording heads 1 are guided and supported in such positional relationship that the discharge ports 52 are arranged in a direction intersecting with the direction of main scanning movement (in the present embodiment wherein the recording heads are carried on the carriage 2, the direction of movement of the carriage 2). Thus, the recording means (recording heads) 1 is constructed in which a corresponding electrothermal converting means 55 is driven (a pulse voltage is applied) on the basis of an image signal or a discharge signal to thereby film-boil the ink in the liquid path 54 and an ink droplet is discharged from the discharge port 52 by pressure created at that time.

Figure 3:
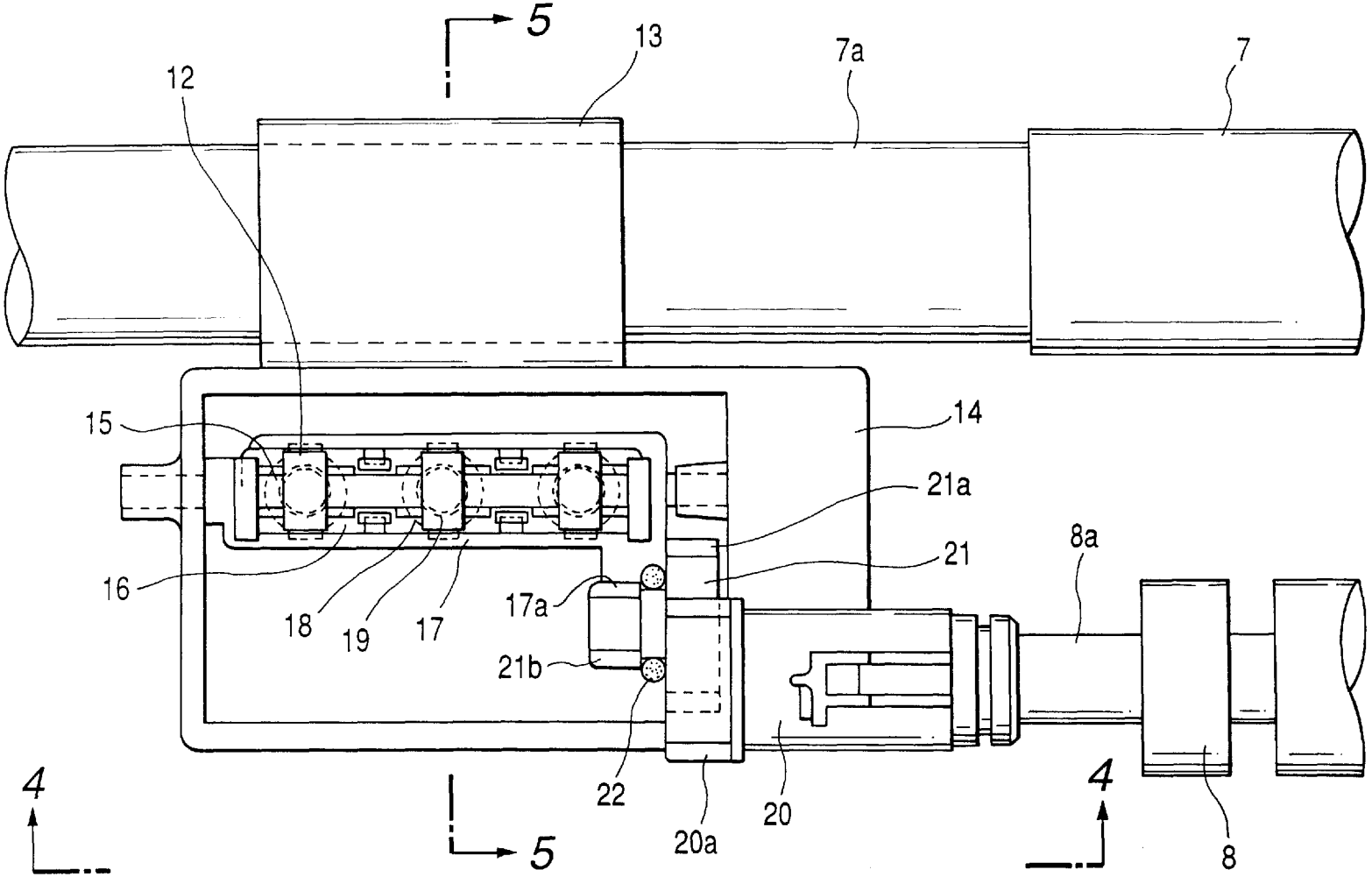
FIG. 3 is a typical plan view, partly in cross-section, showing contacting members in FIG. 1 and the construction of the vicinity thereof.
Figure 4:
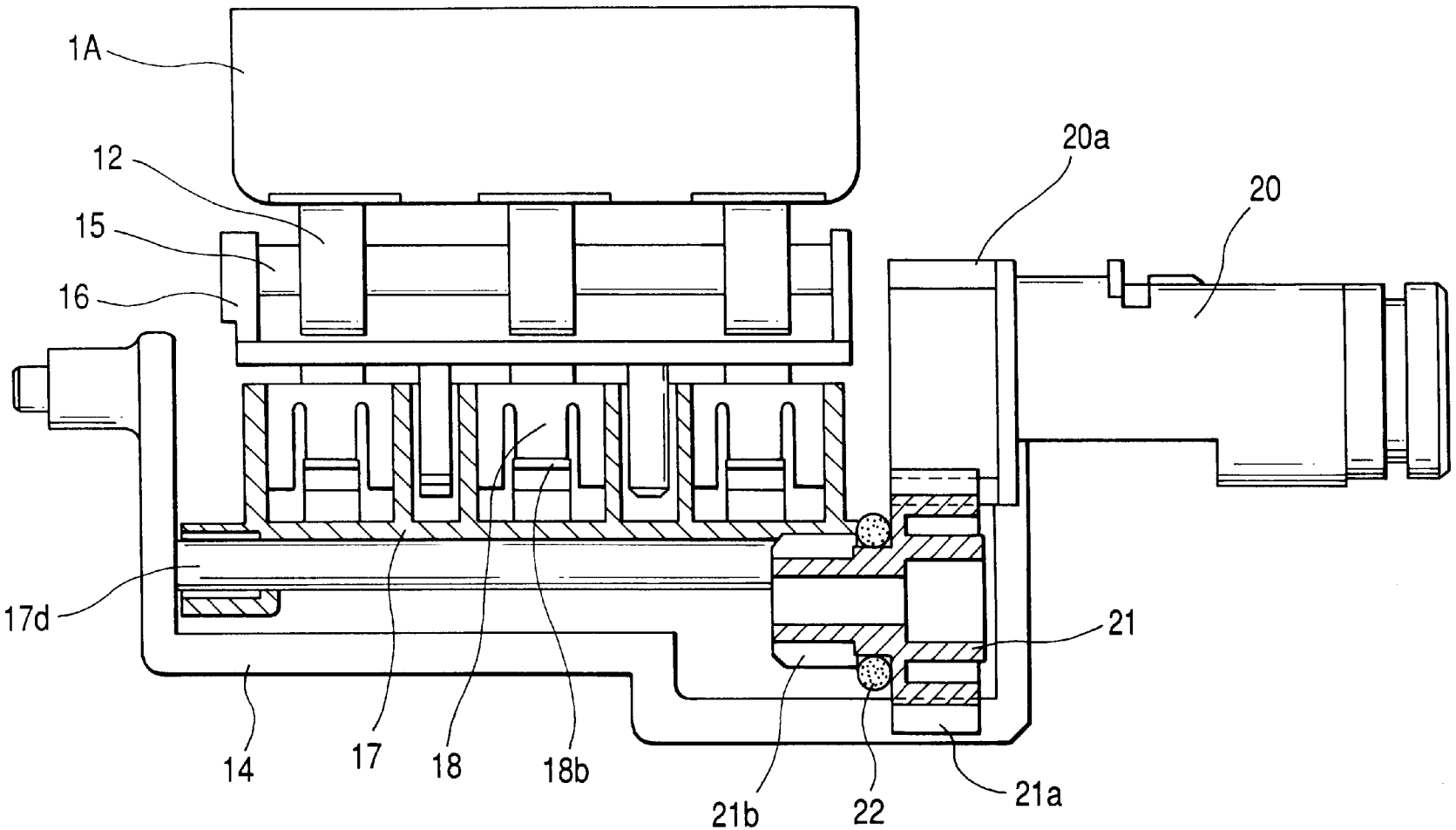
FIG. 4 is a typical front view taken along the line 4—4 of FIG. 3.
Figure 5:
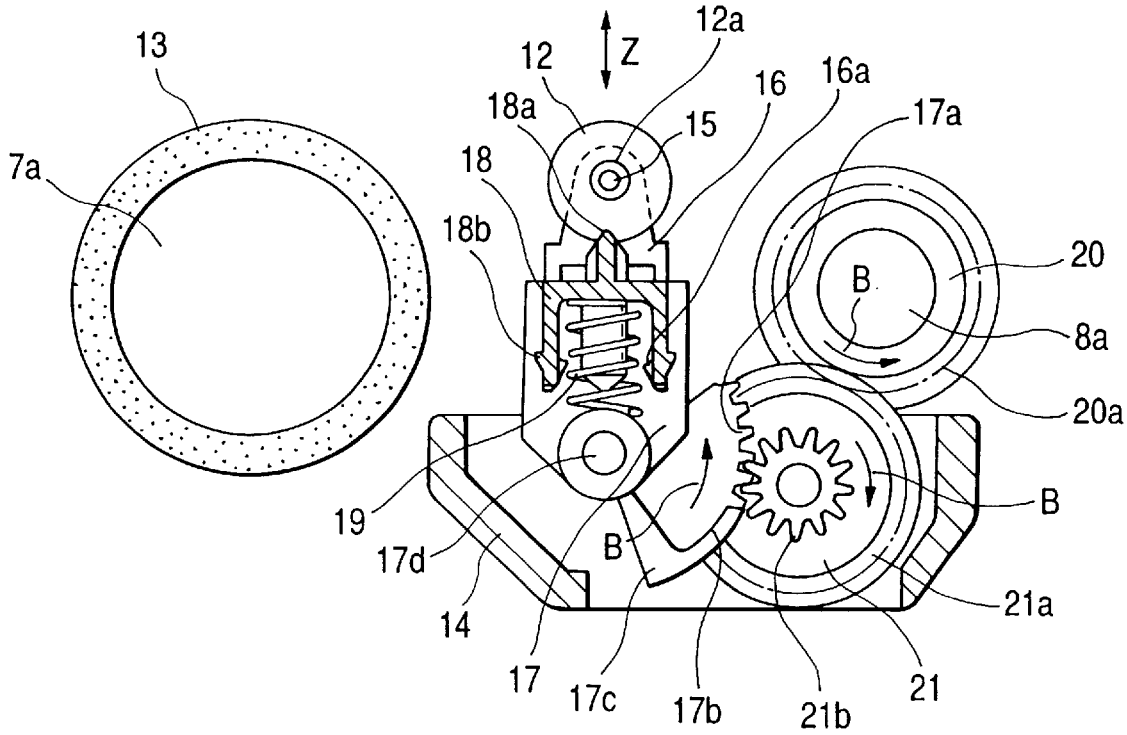
FIG. 5 is a typical side cross-sectional view taken along the line 5—5 of FIG. 3.

FIG. 3 is a typical plan view, partly in cross-section, showing the contacting members 12 in FIG. 1 and the construction of the vicinity thereof, FIG. 4 is a typical front view taken along the line 4—4 of FIG. 3, and FIG. 5 is a typical side cross-sectional view taken along the line 5—5 of FIG. 3. In FIGS. 3 to 5, the contacting members 12 are disposed between the line feed roller 7 and the paper discharging roller 8, and the re-transfer member 13 is mounted around the shaft portion 7*a* of the line feed roller 7. This re-transfer member 13 is formed by an ink absorbent member. The reference numeral 14 designates a wiping base for supporting the contacting members 12 and a driving system which will be described later.

Each of the contacting members 12 is formed into a cylindrical shape, and is formed with a through-hole in the central portion thereof. Each of the three contacting members 12 corresponding to the three series of discharging surfaces 51 of the ink jet recording head 1A is fixed to a wiping shaft 15 by the aforementioned through-hole. This wiping shaft 15 is supported by a wiping holder 16 so as to be rotatable at the left and right end portions thereof. Thereby, the cylindrical contacting member (wiping member) 12 is rotatable with the center of the cylinder thereof as the axis.

The wiping holder 16 is held for sliding in a vertical direction (the direction of arrow Z) relative to a wiping arm 17, which is mounted on the wiping base 14 so as to be rotatable about the center of rotation 17*d* thereof. A wiping control member 18, like the wiping holder 16, is also held for sliding in the vertical direction (the direction of arrow Z) relative to the wiping arm 17. A wiping spring 19 is mounted between the wiping control member 18 and the wiping arm 17, and the wiping control member 18 is biased upwardly as viewed in FIG. 5 by the wiping spring 19 (the resilient force thereof). A wiping control portion 18*a* is provided on the upper portion of the wiping control member 18 so that the wiping member (contacting member) 12 may be upwardly biased through the wiping control portion 18*a*. Also, a stopper portion 18*b* is provided on the lower portion of the wiping control member 18 so that the wiping control member 18 may not move beyond a predetermined amount. That is, design is made such that the biasing force of the wiping spring imparted to the contacting member 12 through the wiping control portion 18*a* of the wiping control member 18 dies away at a point of time whereat the wiping control member 18 has been upwardly moved by a predetermined amount.

In FIGS. 3 to 5, together with the wiping members (contacting members) 12, the wiping holder 16 and the wiping shaft 15 supporting the wiping members 12 receive the upward biasing force (spring resilient force) by the wiping spring 19 at a time. The wiping holder 16, like the wiping control member 18, is also provided with a stopper portion 16*a* for the wiping arm 17 so that the wiping holder 16 may be prevented from moving upwardly as viewed in FIG. 4 beyond a predetermined amount. That is, the stopper portion 16*a* provides the anti-slippage means of the wiping holder 16 relative to the wiping arm 17. Here, design is made such that the biasing force of the wiping spring 19 is nullified by the stopper portion 18*b* of the wiping control member 18 before the stopper portion 16*a* of the wiping holder 16 works. Therefore, the biasing force of the wiping spring 19 does not act on the contacting members 12 at least when the contacting members (wiping members) 12 are not in contact with the discharging surfaces 51 of the ink jet recording head 1A.

A one-way clutch 20 is provided on the shaft portion 8*a* of the paper discharging roller 8. This one-way clutch 20 is designed to transmit a driving force during reverse rotation and idly rotate during forward rotation, and transmits a driving force for the wiping arm 17 to rotate about a shaft portion (the center of rotation) 17*d* during reverse rotation. The gear portion 20*a* of the one-way clutch 20 is in meshing engagement with the large-diametered gear portion 21*a* of an idle gear 21 which is a two-stage gear. It is possible to rotatively drive the wiping arm 17 by the driving force from the one-way clutch 20 through the large-diametered gear portion 21*a* and small-diametered gear portion 21*b* of the idle gear 21 which is a two-stage gear and the gear portion 17*a* of the wiping arm 17.

The gear portion 17*a* of the wiping arm 17, when rotated by a predetermined amount or greater, has its gear transmission (the drive transmission by the gear) released by the untoothed portion 17*b* (FIG. 5) thereof. Also, an idle rubber ring 22 is mounted on the idle gear 21, and immediately before the releasing of the aforementioned gear transmission (the releasing of the drive transmission by the gear), the frictional transmitting portion 17*c* of the wiping arm 17 comes into frictional engagement with the idle rubber ring 22. Thereby, still after the releasing of the drive transmission by the gear, the wiping arm 17 is rotatively driven in the direction of arrow B in FIG. 5 through the idle rubber ring 22.

When the paper discharging roller 8 is further rotated reversely, the wiping members (contacting members) 12 is brought into contact with the re-transfer member 13 by the further rotation of the wiping arm 17 in the direction of arrow B, whereupon the rotation of the wiping arm 17 is blocked. At this time, idle rotation takes place between the idle rubber ring 22 and the frictional transmitting portion 17*c* of the wiping arm 17. Also, at this time, the small-diametered gear portion 21*b* of the idle gear 21 is located on the untoothed portion 17*b* of the wiping arm 17 and is sufficiently separate from the gear portion 17*a* of the wiping arm 17 and therefore, the rubbing noise or the like of the gear does not occur.

Figure 6:
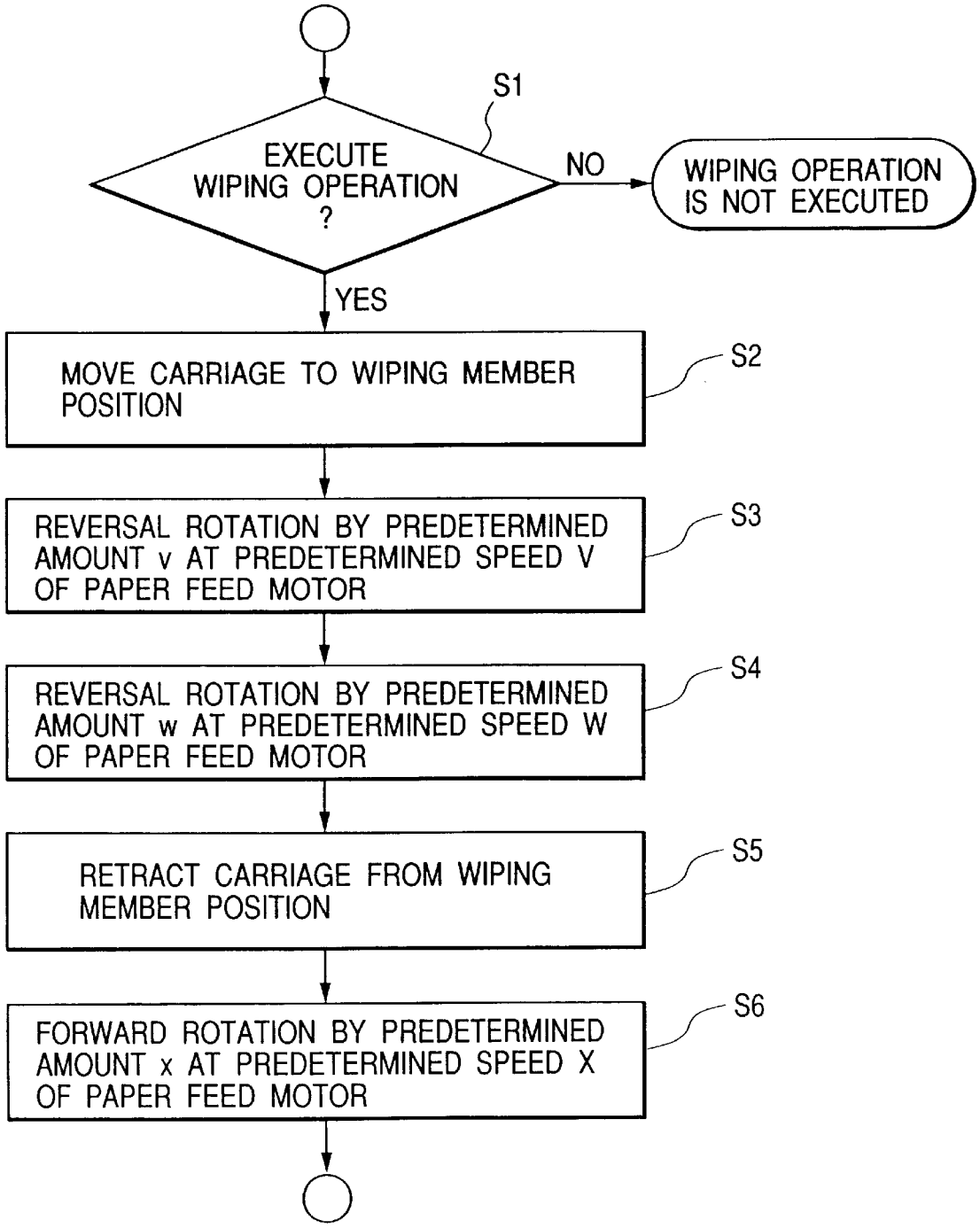
FIG. 6 is a flow chart showing the series of operations of the cleaning process for recording means in an embodiment of an ink jet recording apparatus to which the present invention is applied.
Figure 7:
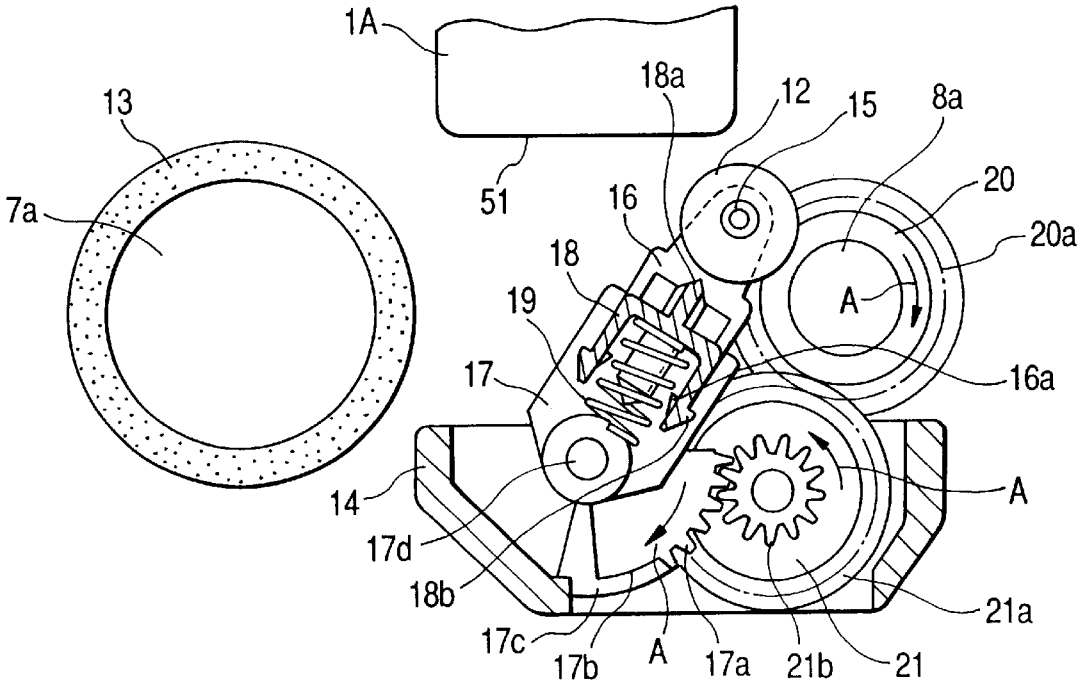
FIG. 7 is a typical side cross-sectional view corresponding to FIG. 5 but showing the state in the ink jet recording apparatus according to the present invention immediately before a contacting member contacts with the recording means.
Figure 8:
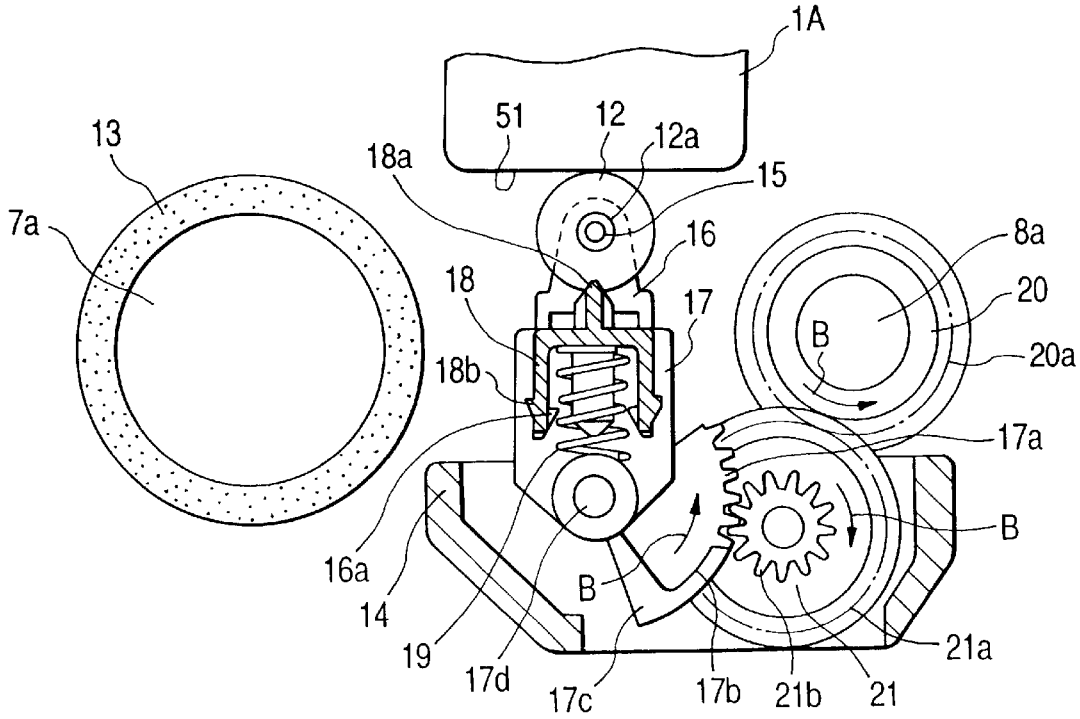
FIG. 8 is a typical side cross-sectional view showing a state in which a wiping arm is rotated from the state of FIG. 7 and the contacting member is in contact with the recording means.
Figure 9:
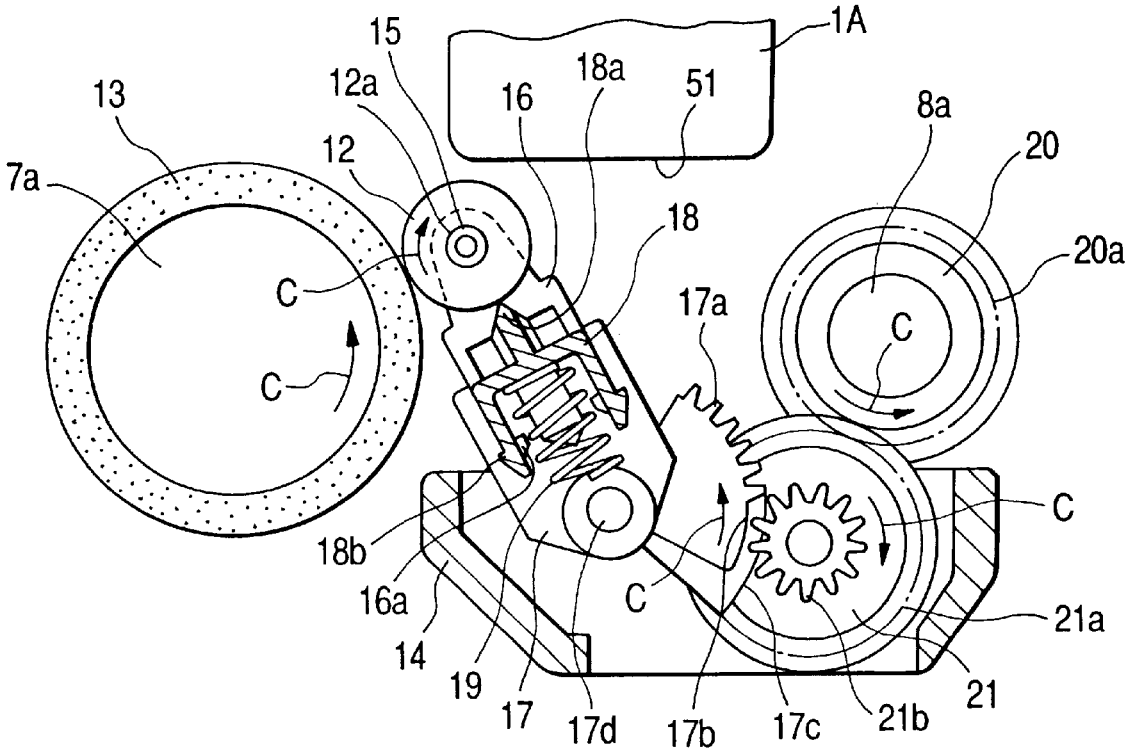
FIG. 9 is a typical side cross-sectional view showing a state in which the wiping arm is further rotated from the state of FIG. 8 and the contacting member is in contact with a re-transfer member.

FIG. 6 is a flow chart showing a series of operations when cleaning a recording head in an embodiment of an ink jet recording apparatus to which the present invention is applied, FIG. 7 is a typical side cross-sectional view corresponding to FIG. 5 but showing the state immediately before the contacting member in the ink jet recording apparatus according to the present invention contacts with the recording head, FIG. 8 is a typical side cross-sectional view corresponding to FIG. 5 but showing a state in which the contacting member in the ink jet recording apparatus according to the present invention is in contact with the recording head, and FIG. 9 is a typical side cross-sectional view corresponding to FIG. 5 but showing a state in which the contacting member in the ink jet recording apparatus according to the present invention is in contact with the re-transfer member. A series of operations by the cleaning device described in connection with FIGS. 3 to 5 will hereinafter be described with reference to FIGS. 6 to 9.

When the ordinary paper feeding forward rotation is being effected, the shaft portion 8*a* of the paper discharging roller 8 is rotated in the direction of arrow A in FIG. 7 and the one-way clutch 20 is idly rotating with predetermined torque. This predetermined torque acts on the idle gear 21 in the direction of arrow A and further acts on the wiping arm 17 also in the direction of arrow A. Accordingly, in the state of FIG. 7, the wiping arm 17 is held in a position in which it is stopped by a stopper, not shown, i.e., a position as shown in FIG. 7 wherein the contacting member (wiping member) 12 is in contact with neither of the recording head 1 (IA or 1B) and the paper discharging roller shaft portion 8*a*.

When at the step S1 of FIG. 6, it is judged that the wiping operation is to be executed, at a step S2, the recording heads 1 carried on the carriage 2 is first positioned right above the wiping base 14 on which the wiping member 12 is mounted. For which recording head 1 or for which discharging surface 51 the wiping operation is to be executed is determined by the position of the carriage 2. In the present embodiment, the recording head 1A is provided with three series of discharging surfaces 51, and there are disposed discharging surfaces for black ink and a discharging surface for liquid for making the dye undissolvable is disposed in the middle therebetween. On the other hand, the recording head 1B is also provided with three series of discharging surfaces 51 for yellow, magenta and cyan inks, respectively. In the recording head 1A, there is present the discharging surface for the liquid for making the dye undissolvable and therefore, ink increased in viscosity which is difficult to wipe off by a wiper or the like formed of an elastic material such as rubber is liable to adhere. So, in the present embodiment, three contacting member (wiping members) 12 are disposed at positions which correspond only to the three series of discharging surfaces of the recording head 1A and do not correspond to the recording head 1B.

At the step S3 of FIG. 6, a paper feed motor (LF motor) is rotated reversely by a predetermined amount v at a predetermined speed V. The operation at this time will hereinafter be described with reference to FIG. 8. The paper discharging roller 8 is rotated in the direction of arrow B as shown in FIG. 8, and the one-way clutch 20 is also rotated in the direction of arrow B. As previously described, the gear portion 20*a* of the one-way clutch 20 is in engagement with the idle gear 21 and therefore, the idle gear 21 is also rotated in the direction of arrow B. Further, by the engagement between the small-diametered gear portion 21*b* of this idle gear 21 and the gear portion 17*a* of the wiping arm 17, the wiping arm 17 is also rotatively driven in the direction of arrow B about an axis 17*d*.

With this rotating operation of the wiping arm 17, the wiping holder 16 and wiping shaft 15 slidably mounted on the wiping arm 17 perform a pivotally (swingingly) moving operation and further, the wiping member (contacting member) 12 supported on the wiping shaft 15 also performs a pivotaly moving operation. On the other hand, the discharging surface 51 of the recording head 1A is right above the wiping member 12, and the upward movement of the wiping member 12 is blocked (regulated). That is, in the state of FIG. 8, the wiping spring 19 becomes charged, and the stopper portion 18*b* of the wiping control member 18 is free relative to the wiping arm 17, and the wiping control portion 18*a* of the wiping control member 18 is engaged with and biases the wiping member 12 (the wiping holder 16).

Accordingly, with the pivotally (swingingly) moving operation of the wiping arm 17 in the direction of arrow B, the wiping member (contacting member) 12 rectilinearly moves along the discharging surface 51 of the recording head 1A. Also, when the contacting member 12 is in contact with the discharging surface 51 of the recording head 1A, the contacting member 12 is urged against the discharging surface 51 with predetermined pressure by the wiping spring 19, and slides under a predetermined pressure contact force. Also, the rotatably supported contacting member 12 is usually rotated when it rectilinearly moves while contacting with the discharging surface 51 of the recording head 1A, but since as previously described, the wiping control portion 18*a* of the wiping control member 18 is in engagement with the contacting member 12 from the opposite side of the recording head 1A, the rotation of the contacting member (wiping member) 12 can also be stopped by the utilization of the wiping control portion 18*a*. The wiping member 12 thus bears against the discharging surface 51 with predetermined pressure, whereby a stable and reliable wiping operation (cleaning operation) becomes possible. Also, by the rotation of the wiping member 12 being stopped, not only simply contacting but also a reliable rubbing-off operation becomes possible.

The predetermined speed V at the step S3 in FIG. 6 is selected to a speed optimum for the wiping operation. Also, the predetermined amount of reverse rotation v at the step S3 in FIG. 6 means the amount of rotation from the start to the end of the wiping operation, that is, until the wiping member 12 comes from the state of FIG. 7 via the state of FIG. 8 to the state of FIG. 9 (a position in which it contacts with the re-transfer member 13).

Figure 10:
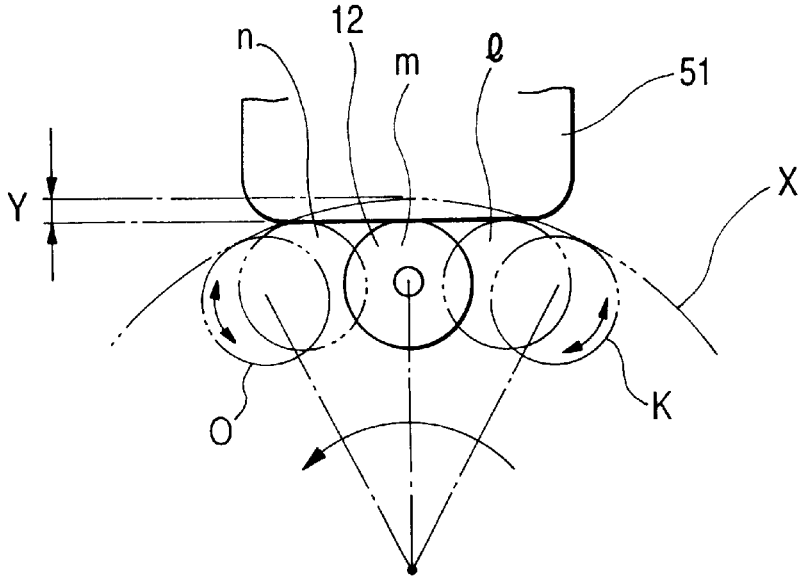
FIG. 10 is a typical view for illustrating an operation performed at a step S3 in FIG. 6.
Figure 11:
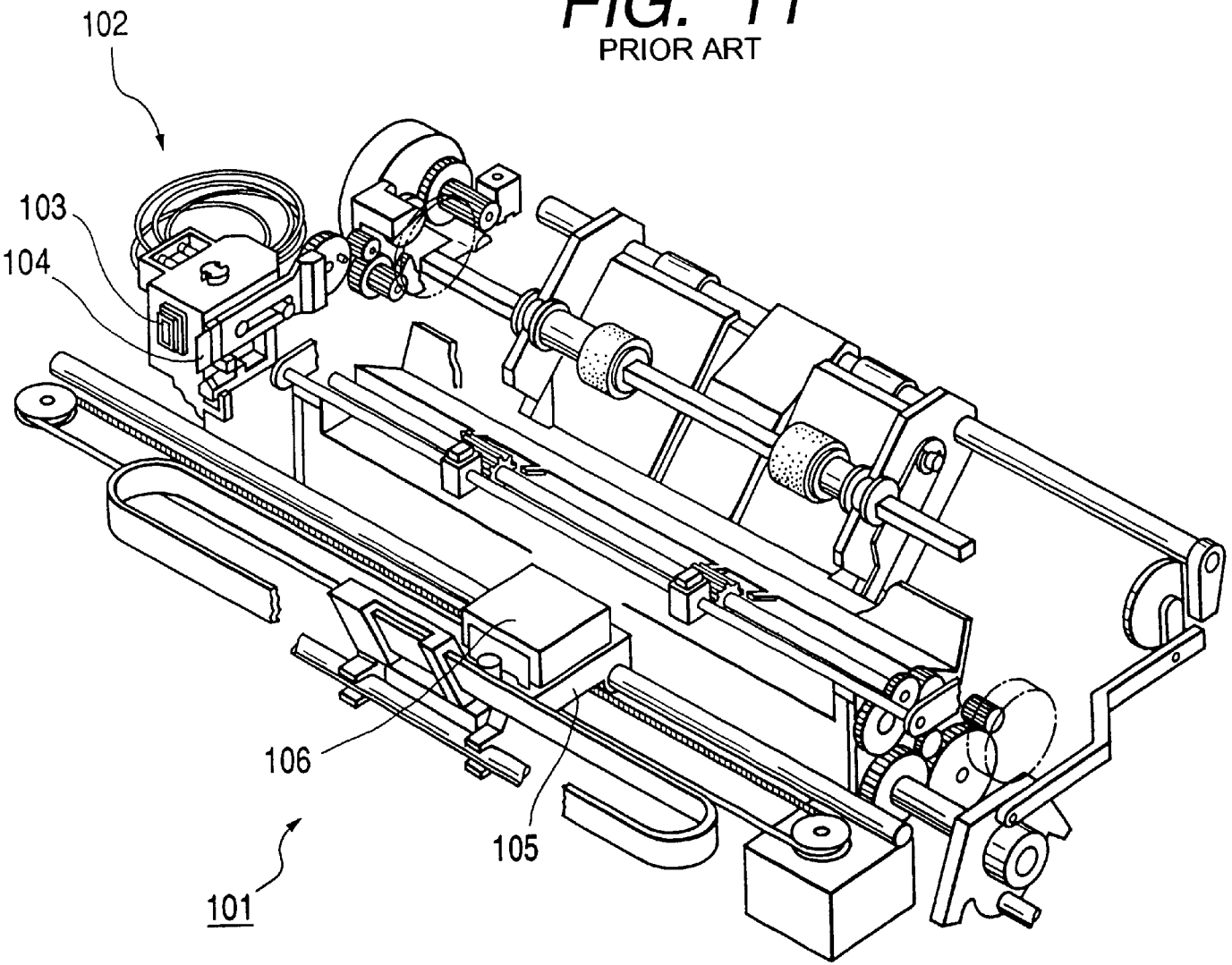
FIG. 11 PRIOR ART
FIG. 11 is a typical perspective view schematically showing the construction of an ink jet recording apparatus provided with a recording system according to the prior art.
Figure 12:
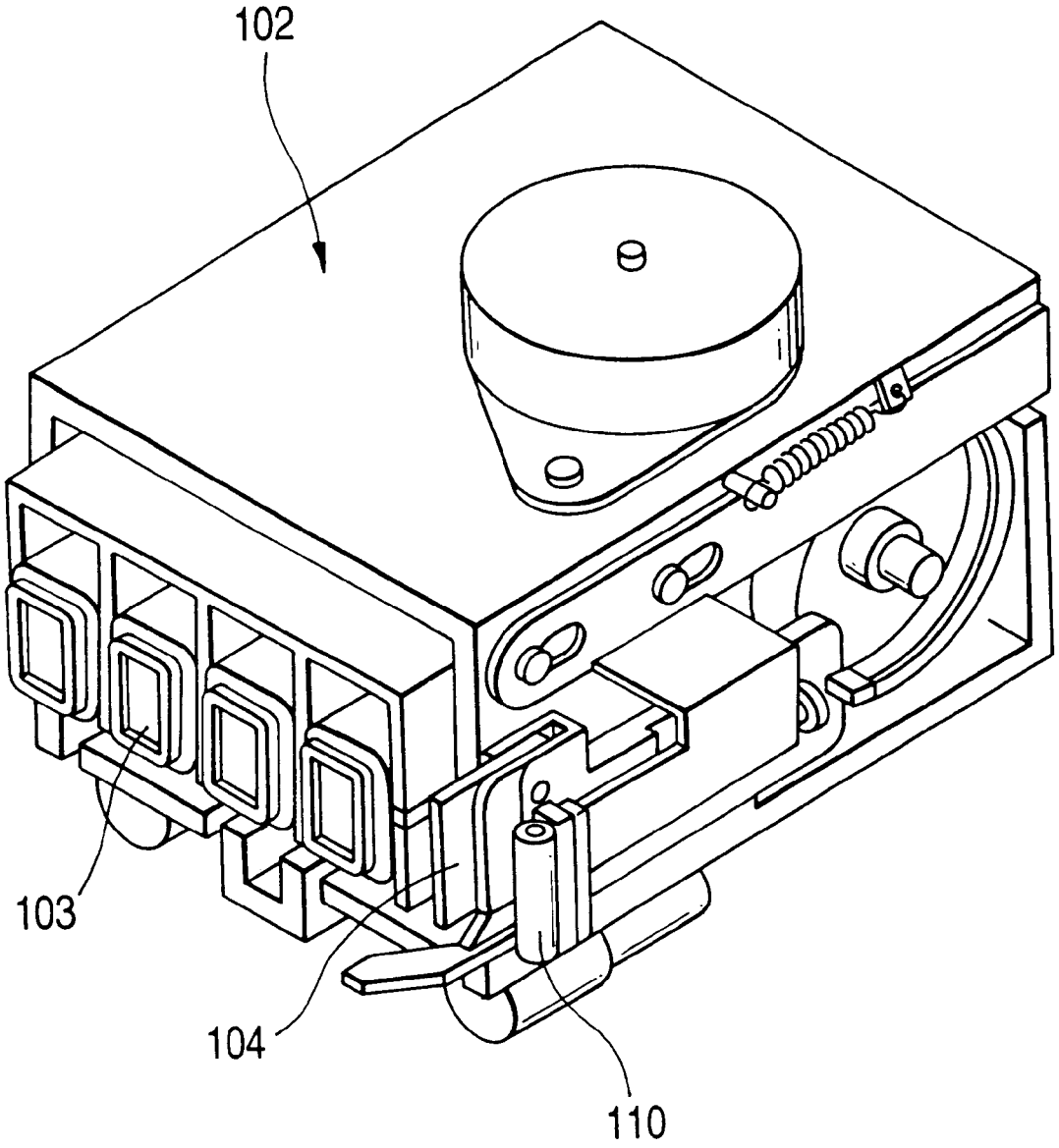
FIG. 12 PRIOR ART
FIG. 12 is a typical perspective view showing an example of the recovery system of an ink jet recording apparatus according to the prior art.
Figure 13A:
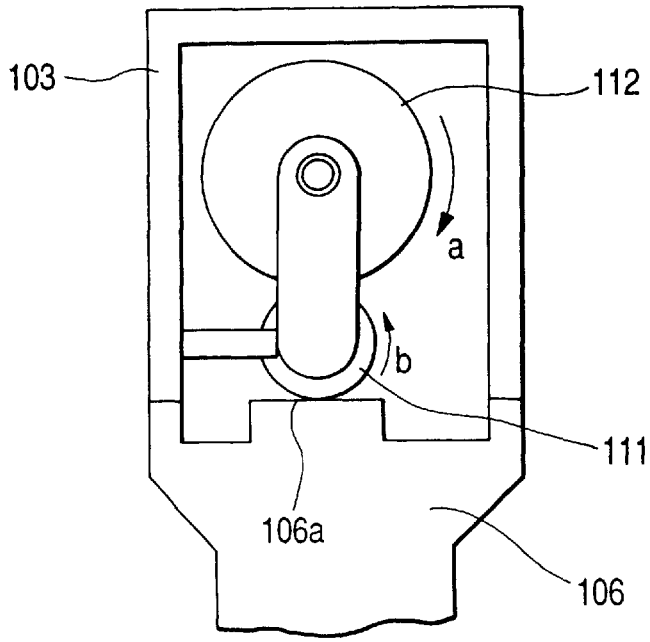
FIG. 13A PRIOR ART
FIGS. 13A and 13B are typical views showing another example of the recovery system according to the prior art, FIG. 13A showing a head cleaning state, and FIG. 13B showing a retracted state.
Figure 13B:
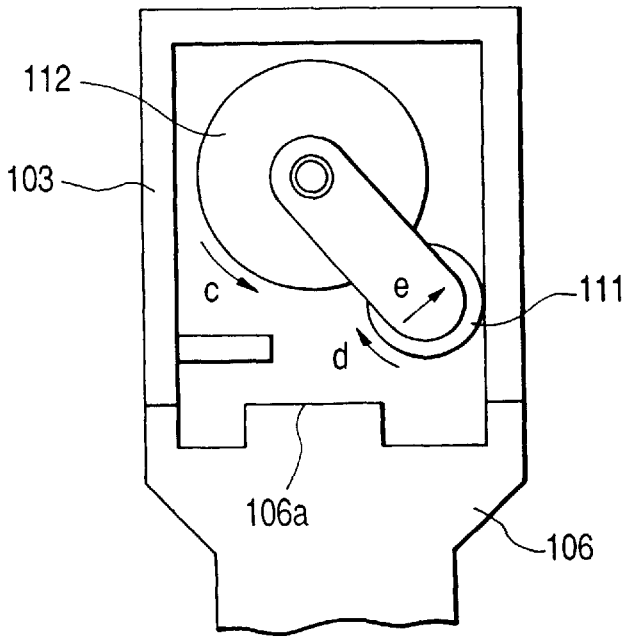
FIG. 13B PRIOR ART
Figure 14A:
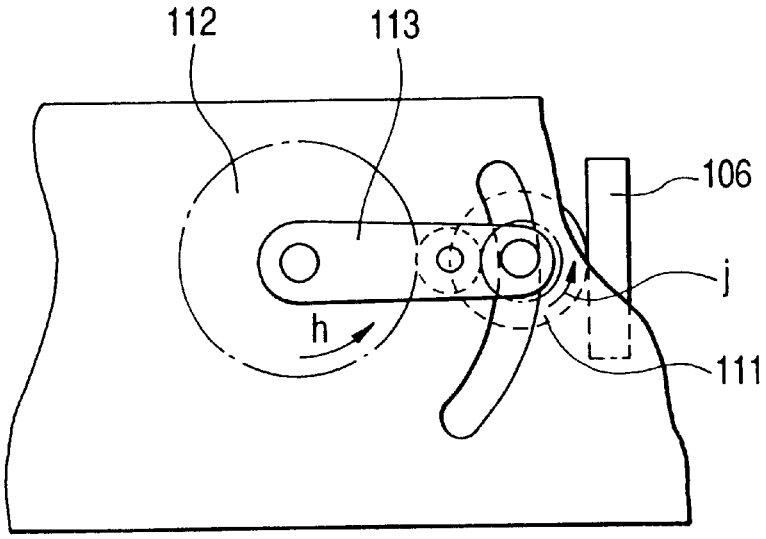
FIG. 14A PRIOR ART
FIGS. 14A, 14B and 14C are typical views showing still another example of the recovery system according to the prior art, FIG. 14A being a side view schematically showing the whole of a cleaning mechanism, and FIGS. 14B and 14C being typical views showing a cleaning state in succession.
Figure 14B:
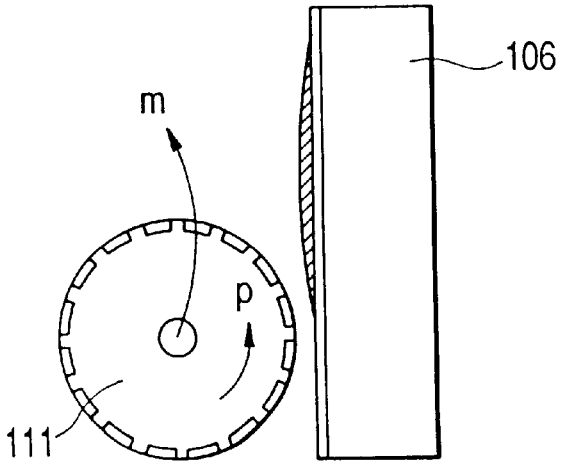
FIG. 14B PRIOR ART
Figure 14C:
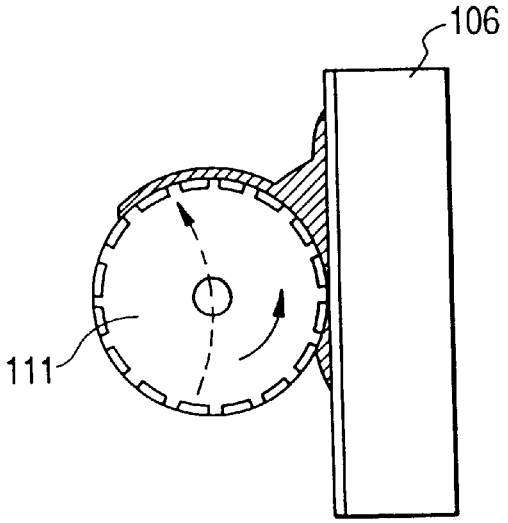
FIG. 14C PRIOR ART

FIG. 10 is a typical view showing the operation executed at the step S3 in FIG. 6. Dots-and-dash line X is a locus described by the uppermost end of the contacting member 12 when the head 51 is absent, and when for example, the contacting member 12 is at a position indicated by m, pressing-in by a distance Y is effected by the head 51. When the contacting member 12 is at k, it is rotatable and the contact thereof with the head 51 is started from the vicinity of a position 1, and it passes the position 1 and comes close to the position m, whereby the fixing of the rotation thereof is gradually done. By the contacting member 12 beginning to contact with the head 51 in its rotatable state, the contacting member 12 can smoothly start its contact with the head 51 and does not require any excess pivotally driving force. Thereafter, as the contacting member 12 begins to leave the head 51 from the vicinity of a position n through the position m and comes close to a position o, the rotation thereof becomes possible, and when it comes to the position o, the contacting member 12 becomes rotatable.

Next, as shown at a step S4 in FIG. 6, the reverse rotating operation is further executed and the operation of cleaning the wiping member (contacting member) 12 by the re-transfer member 13 is performed. This cleaning step will hereinafter be described with reference to FIG. 9. By the reverse rotating operation (the rotation in the direction of arrow C in FIG. 9) of the paper discharging roller 8, as in the case of FIG. 8, the wiping arm 17 performs a pivotally (swingingly) moving operation in the same direction, and the contacting member (wiping member) 12 assumes a position in which it contacts with the re-transfer member 13 as shown in FIG. 9.

In that case, the small-diametered gear portion 21*b* of the idle gear 21 changes over from its meshing state with the gear portion 17*a* of the wiping arm 17 to its state opposed to the untoothed portion 17*b* (non-engaged state) immediately before the contacting member (wiping member) 12 contacts with the re-transfer member 13. In the further reverse rotation subsequent thereto, drive transmission is effected by the frictional force between the idle rubber ring 22 mounted on the idle gear 21 and the frictional transmitting portion 17*c* of the wiping arm 17. Thus, when the contacting member 12 is in contact with the re-transfer member 13, the driving force of the paper discharging roller 8 idly rotates on the frictional transmitting portion 17*c*. Also, the idle rotational force generated at this time becomes the contact pressure (pressure contact force) between the contacting member 12 and the re-transfer member 13.

On the other hand, as shown in FIG. 9, during the reverse rotation of the paper discharging roller 8, the paper feed roller 7 also performs a reverse rotating operation and is rotating in the direction of arrow C, and the re-transfer member 13 mounted on the shaft portion 7*a* of the paper feed roller 7 is also rotated in the direction of arrow C. This re-transfer member 13 is formed by an ink absorbent member. Further, by the rotation of this re-transfer member 13 in the direction of arrow C, the wiping member (contacting member) 12 which is in contact therewith is also rotatively driven in the direction of arrow C and at the same time, the cleaning of the wiping member 12 is effected. Also, at this time, the wiping control member 18 described with reference to FIG. 8 is held at a constant position by the stopper portion 18*b* thereof, and the rotation of the wiping member 12 is effected freely.

The predetermined speed W of the paper feed motor at the step S4 in FIG. 6 is selected to a speed optimum for cleaning, and the predetermined amount of reverse rotation w is determined from the following three points of view. Firstly, for at least the wiping member 12 to effect one full or more rotation and for the whole of the wiping member 12 to be cleaned. Secondly, for the wiping member 12 to be rotated by a predetermined amount so that during the next contact thereof with the recording head 1A, the position of the contacting portion of the wiping member 12 may shaft (change) sequentially. Thirdly, during the next forward rotation drive transmission, for a predetermined amount of reverse rotation to be effected so that the interference between the gear portions may not occur when return is made from the frictional transmitting state on the untoothed portion 17*b* to the meshing state between the gear portions.

Next, at a step S5 in FIG. 6, the carriage 2 is retracted (moved away) from the position of the wiping member 12, whereafter at a step S6, the returning operation of the wiping member 12 is performed by the reverse rotation of the paper feed motor. The operation at this time is performed in the manner described in connection with FIG. 7. That is, the rotation of each member shown in FIG. 7 in the direction of arrow A is effected by the idle rotation torque of the one-way clutch by the forward rotating operation of the paper discharging roller 8. The idle rotation torque generated by the one-way clutch 20 is considerably smaller than the torque generated during the reverse rotation shown in FIG. 8, but since the recording head 1A has been retracted (moved) to other position, the idle rotation torque can be easily set to sufficient torque to return the wiping member 12, and is so set. After sufficient forward rotation has been effected, the wiping member is held in its state shown in FIG. 7. By the series of operations described above, a foreign substance such as viscosity-increased ink adhering to the discharging surfaces 51 of the recording head 1 can be reliably wiped off and removed in a stable state.

According to the above-described construction, at a position for starting frictional contact with the recording head, the rotatable member is in a rotatable state in accordance with the direction of movement thereof and therefore, the rotatable member can well move into the discharging surfaces of the recording head and any great load is generated neither to the rotatable member nor to the recording head. Also, the rotatable member is fixed when it passes the vicinity of the discharge ports and therefore, not only the ink and dust but also solidified materials can be reliably removed. Also, in an area wherein the rotatable member on the discharging surfaces starts to contact, sufficient cleaning is effected by the contact with the rotatable member. Particularly, for the cleaning mechanism designed to be rotated against the direction of movement of the rotatable member, the load is mitigated both to the cleaning member and to the recording head and therefore, the long-period stability of the cleaning mechanism and the long-period stable discharge of the recording head can be achieved.

Thus, only the necessary portions can be firmly and effectively cleaned and therefore, it is difficult for the discharging surfaces of the recording head and the cleaning member to be deteriorated and a stable cleaning characteristic for a long period can be maintained and it is difficult for the head to be injured and therefore, stable ink discharge can be achieved and good recording can be maintained for a long period.

While the above embodiment has been described with respect to an ink jet recording apparatus of the serial recording type in which recording is effected while the recording means is moved relative to the recording material, the present invention can also be equally applied to an ink jet recording apparatus of the line recording type in which recording is effected only by sub-scanning by the use of recording means of the line type having a length covering the full width or a part of a recording material, and a similar effect can be achieved.

Further, the present invention can also be likewise applied to a recording apparatus using a single recording means, a color recording apparatus using a plurality of recording means for recording with inks of different colors, or a gradation recording apparatus using a plurality of recording means for recording in the same color at different densities, or further a recording apparatus in which these are combined together, and a similar effect can be achieved.

Further, the present invention can also be likewise applied to any construction of a recording head and an ink tank such as a construction using an interchangeable ink cartridge comprising a recording head and an ink tank made into a unit, or a construction in which a recording head and an ink tank are discrete from each other and are connected together by an ink supplying tube or the like, and a similar effect can be obtained.

As is apparent from the foregoing description, according to the present invention, an ink jet recording apparatus for discharging ink from recording means to a recording material to thereby effect recording has a contacting member for cleaning the discharging surface of the recording means and the position of the portion of contact of the contacting member with the discharging surface is made variable and therefore, the position of the portion of contact of the contacting member with the discharging surface is not fixed to a predetermined location but can be sequentially shifted, whereby it becomes possible to prevent or mitigate the contamination or surface deterioration of the contacting member and also, the cleaning performance for the discharging surface can be maintained for a long period and thus, it becomes possible to effect stable ink discharge for a long period.

Also, the present invention adopts a construction in which the contacting member is rotatable, a construction in which the rotation of the contacting member is fixed when the contacting member contacts with the discharging surface, a construction in which the contacting member contacts with the rotation control member thereof when the contacting member contacts with the discharging surface, a construction in which the rotation control member is biased by a resilient force, a construction in which the contacting member is biased by a necessary resilient force through the rotation control member when the contacting member contacts with the discharging surface, and the contacting member is not biased when the contacting member does not contact with the discharging surface, a construction in which the contacting member is formed by an absorbent member, a construction in which a unit supporting the contacting member is rotatively driven, a construction in which the contacting member is substantially rectilinearly moved when the contacting member contacts with the discharging surface, a construction in which a unit supporting the contacting member is driven by a paper feed motor, a construction in which the cleaning operation for the discharging surface is performed when the unit is rotatively driven in a predetermined direction by the paper feed motor, and the returning operation for the contacting member is performed when the unit is rotatively driven in the opposite direction, a construction in which the cleaning operation for the discharging surface is performed during paper feed reverse rotation, a construction in which the driving force for the unit is transmitted from a paper discharging roller, a construction in which the driving force for the unit is transmitted through a clutch, a construction in which the driving force for the unit is transmitted through a one-way clutch and the untoothed portion of a gear, or a construction in which transmitting means for the driving force for the unit has the untoothed portion and frictional driving portion of a gear, and therefore the effect can be achieved more efficiently by the ink jet recording apparatus for discharging ink from recording means to a recording material to thereby effect recording, characterized by a contacting member for cleaning the discharging surface of the recording means, said contacting member being rotatable until immediately before it contacts with said discharging surface, the rotation of said contacting member being fixed when said contacting member contacts with said discharging surface.

Further, an ink jet recording apparatus for discharging ink from recording means to a recording material to thereby effect recording has a contacting member for cleaning the discharging surface of the recording means, and the contacting member is rotatable until immediately before it contacts with the discharging surface, and the rotation of the contacting member is fixed when the contacting member contacts with the discharging surface and therefore, without any excess driving force being required, the cleaning performance for the discharging surface can be maintained for a long period, and it becomes possible to effect stable ink discharge for a long period.

Also, an ink jet recording apparatus for discharging ink from recording means to a recording material to thereby effect recording has a contacting member for cleaning the discharging surface of the recording means and a re-transfer member for contacting with the contacting member and therefore, the portion of contact of the contacting member with the discharging surface is cleaned by the re-transfer member, whereby the contamination of the contacting member can be prevented and as the result, the cleaning performance for the discharging surface can be maintained for a long period, and it becomes possible to effect stable ink discharge for a long period.

Further, the present invention adopts a construction in which the contacting member and the re-transfer member are spaced apart from each other when the contacting member contacts with the discharging surface, and the contacting member and the re-transfer member come into contact with each other when the contacting member does not contact with the discharging surface, a construction in which the contacting member and the re-transfer member are rotatable, a construction in which the contacting member is rotated by the rotative driving of the re-transfer member when the contacting member contacts with the re-transfer member, a construction in which at least the contacting member effects one full rotation when the contacting member contacts with the re-transfer member, a construction in which the portion of contact of the contacting member with the discharging surface is moved by the rotation of the contacting member when the contacting member contacts with the re-transfer member, a construction in which the re-transfer member is provided around a paper feed roller, or a construction in which the contacting member contacts with the re-transfer member during paper feeding reverse rotation and therefore, the effect can be achieved more efficiently by the ink jet recording apparatus for discharging ink from recording means to a recording material to thereby effect recording, characterized by a contacting member for cleaning the discharging surface of the recording means, said contacting member being rotatable until immediately before it contacts with said discharging surface, the rotation of said contacting member being fixed when said contacting member contacts with said discharging surface, characterized in that a unit supporting said contacting member is driven by a paper feed motor, and characterized in that the cleaning operation for the discharging surface is performed during paper feeding reverse rotation.

Also, in an ink jet recording apparatus for discharging ink from recording means to a recording material to thereby effect recording has a contacting member for cleaning the discharging surface of the recording means, and adopts a construction in which during paper feeding reverse rotation, the discharging surface and the contacting member are moved relative to each other while contacting with each other, and during further paper feeding reverse rotation, the contacting member and a re-transfer member rotatably contact with each other, and during paper feeding forward rotation, the contacting member is returned to its initial position and therefore, the portion of contact of the contacting member with the discharging surface can be cleaned by the re-transfer member during paper feeding reverse rotation and thus, it becomes possible to prevent the contamination of the contacting member by simple control and as the result, the cleaning performance for the discharging surface can be maintained for a long period, and it becomes possible to effect stable ink discharge for a long period.

Further, an ink jet recording apparatus for discharging ink from recording means to a recording material to thereby effect recording has a contacting member for cleaning the discharging surface of the recording means and a cap member for protecting the discharging surface, and adopts a construction in which the contacting member and the cap member are disposed on opposite sides with a recording area therebetween and therefore, it becomes possible to secure a space sufficient to sequentially shift (change) the position of the portion of contact of the contacting member with the discharging surface or to clean the contacting member by a re-transfer member and as the result, it becomes possible to prevent or mitigate the contamination or surface deterioration of the contacting member and maintain the cleaning performance for the discharging surface for a long period, and it becomes possible to effect stable ink discharge for a long period.

What is claimed is:

1. An ink jet recording apparatus for executing recording by discharging ink from recording means to a recording material, comprising:

a cleaning member for cleaning a discharge face of said recording means, wherein the cleaning member is provided with a rotating-type cleaner portion, a rotationally-movable support member for supporting and moving the cleaner portion to a cleaning position and a non-cleaning position, and a stopper which maintains said cleaner portion in a non-rotatable state with respect to said support member when said cleaner portion is moved to the cleaning position by the support member in which said cleaner portion abuts to said discharge face, and the stopper places said cleaner portion in a rotatable state with respect to said support member when said cleaner portion is moved to the non-cleaning position by the support member in which said cleaner portion is not abutted to said discharge face.

2. An ink jet recording apparatus according to claim 1, characterized by a re-transfer member for contacting with said cleaner portion.

3. An ink jet recording apparatus according to claim 2, characterized in that said cleaner portion and said re-transfer member are spaced apart from each other when said cleaner portion contacts with said discharging surface, and said cleaner portion and said re-transfer member contact with each other when said cleaner portion does not contact with said discharging surface.

4. An ink jet recording apparatus according to claim 2, characterized in that said cleaner portion and said re-transfer member are rotatable.

5. An ink jet recording apparatus according to claim 4, characterized in that said cleaner portion is rotated by the rotative driving of said re-transfer member when said cleaner portion contacts with said re-transfer member.

6. An ink jet recording apparatus according to claim 4, characterized in that at least said cleaner portion effects one full rotation when said cleaner portion contacts with said re-transfer member.

7. An ink jet recording apparatus according to claim 4, characterized in that the portion of contact of said cleaner portion with said discharging surface is moved by the rotation of said cleaner portion when said cleaner portion contacts with said re-transfer member.

8. An ink jet recording apparatus according to claim 2, characterized in that said re-transfer member is provided around a paper feed roller.

9. An ink jet recording apparatus according to claim 2, characterized in that during paper feeding reverse rotation, said cleaner portion contacts with said re-transfer member.

10. An ink jet recording apparatus according to claim 1, characterized in that said cleaner portion contacts with the rotation control member thereof when said cleaner portion contacts with said discharging surface.

11. An ink jet recording apparatus according to claim 10, characterized in that said rotation control member is biased by a resilient force.

12. An ink jet recording apparatus according to claim 10, characterized in that said cleaner portion is biased by a necessary resilient force through said rotation control member when said cleaner portion contacts with said discharging surface, and said cleaner portion is not biased when said cleaner portion does not contact with said discharging surface.

13. An ink jet recording apparatus according to claim 1, characterized in that said cleaner portion is formed by an absorbent member.

14. An ink jet recording apparatus according to claim 1, characterized in that a unit supporting said cleaner portion is rotatively driven.

15. An ink jet recording apparatus according to claim 1, characterized in that said cleaner portion is substantially rectilinearly moved when said cleaner portion contacts with said discharging surface.

16. An ink jet recording apparatus according to claim 1, characterized in that a unit supporting said cleaner portion is driven by a paper feed motor.

17. An ink jet recording apparatus according to claim 16, characterized in that the cleaning operation is performed when said unit is rotatively driven in a predetermined direction by said paper feed motor, and the returning operation for the cleaner portion is performed when said unit is rotatively driven in the opposite direction.

18. An ink jet recording apparatus according to claim 16, characterized in that the cleaning operation for the discharging surface is performed during paper feeding reverse rotation.

19. An ink jet recording apparatus according to claim 16, characterized in that the driving force for said unit is transmitted from a paper discharging roller.

20. An ink jet recording apparatus according to claim 16, characterized in that the driving force for said unit is transmitted through a clutch.

21. An ink jet recording apparatus according to claim 16, characterized in that the driving force for said unit is transmitted through a one-way clutch and the untoothed portion of a gear.

22. An ink jet recording apparatus according to claim 16, characterized in that transmitting means for the driving force for said unit has the untoothed portion and frictional driving portion of a gear.

23. An ink jet recording apparatus comprising:

a feeding mechanism for feeding a recording material to which recording is executed by an adhesion of ink discharged from recording means;

a cleaning mechanism having a rotating-type cleaner portion for cleaning a discharge face of said recording means; and a rotating-type re-transfer mechanism for cleaning said cleaner portion of said cleaning mechanism, wherein, by rotating said feeding mechanism in a direction opposite to a rotational direction for the recording material during recording, said cleaning mechanism is moved to a cleaning position for cleaning said discharge face in which said cleaner portion abuts said discharge face and is maintained in a non-rotatable state with respect to said support member by being engaged with a stopper, wherein, by executing further rotation in the same direction, said cleaning mechanism is moved to a re-transfer position where said cleaner portion of said cleaning mechanism is moved away from said discharge face and is contacted with said re-transfer mechanism to cause said cleaner portion to rotate so as to clean said cleaner portion, and where said cleaner portion is disengaged from the stopper so as to be in a rotatable state with respect to said support member, and wherein said cleaning mechanism is returned to an initial position by rotating said feeding mechanism in a forward direction.

* * * * *

UNITED STATES PATENT AND TRADEMARK OFFICE

CERTIFICATE OF CORRECTION

PATENT NO. : 6,532,025 B1
DATED : March 11, 2003
INVENTOR(S) : Hiramatsu

It is certified that error appears in the above-identified patent and that said Letters Patent is hereby corrected as shown below:

Column 7,
Line 58, "(IA" should read -- (1A --.

Column 9,
Line 19, "position" followed by the numeral "1", both occurrences, should read -- position -- followed by the letter -- l --.

Signed and Sealed this

Ninth Day of December, 2003

JAMES E. ROGAN
*Director of the United States Patent and Trademark Office*